United States Patent [19]

Lichte

[11] 4,201,344

[45] May 6, 1980

[54] SHIFTABLE STATOR SPRINKLER HEAD

[75] Inventor: Leo J. Lichte, Riverside, Calif.

[73] Assignee: The Toro Company, Riverside, Calif.

[21] Appl. No.: 864,016

[22] Filed: Dec. 23, 1977

[51] Int. Cl.[2] ..... B05B 3/16

[52] U.S. Cl. ..... 239/242; 239/206; 415/152 R

[58] Field of Search ..... 239/206, 240–242; 415/152 R, 152 A

[56] References Cited

U.S. PATENT DOCUMENTS

| | | | |
|---|---|---|---|
| 1,187,373 | 6/1916 | Nomiya | 239/242 |
| 3,405,871 | 10/1968 | Mullan | 239/242 X |
| 3,782,638 | 1/1974 | Bumpstead | 239/242 |
| 3,785,565 | 1/1974 | Perry et al. | 239/242 X |
| 3,816,021 | 6/1974 | Lewis et al. | 415/152 X |
| 4,069,976 | 1/1978 | Chauvigné | 239/242 |

FOREIGN PATENT DOCUMENTS

| | | | |
|---|---|---|---|
| 618193 | 2/1949 | United Kingdom | 415/152 |
| 630164 | 10/1949 | United Kingdom | 415/152 |

*Primary Examiner*—Robert W. Saifer

*Attorney, Agent, or Firm*—Poms, Smith, Lande & Rose

[57] ABSTRACT

The present invention discloses a reversible turbine-driven sprinkler head which includes a vaned turbine motor for rotatably driving a nozzle. The turbine is unresponsive to the norml flow of fluid through the sprinkler head to the nozzle. Switchable deflection means are included for deflecting the flow of fluid through the body against the turbine to cause rotation thereof in either of two directions. By deflecting the fluid flow to cause the turbine to rotate in one direction, the nozzle is rotated in one direction. By switching the direction of fluid deflection to cause the turbine to flow in the opposite direction, the nozzle is rotated in the opposite direction. Adjustable means are provided for setting the positions relative to the rotation of the nozzle whereat the deflection of the fluid flow is reversed, whereby the nozzle is caused to repeatably oscillate between a first and a second position.

16 Claims, 8 Drawing Figures

SHIFTABLE STATOR SPRINKLER HEAD

BACKGROUND OF THE INVENTION

The present invention relates to sprinkler heads and more particularly, to automatic sprinkler heads which oscillate between settable first and second positions.

Turbine-driven reversible sprinkler heads are known in the art. A typical prior art configuration of such apparatus is shown in FIG. 1. The sprinkler head generally indicated as 10 comprises a cylindrical body 12, adapted at the lower end thereof, for connection to a vertical riser pipe 14 supplying a source of fluid 16 under pressure. The fluid 16 is typically water being used for the selective irrigation of a desired area. The upper end of cylindrical body 12 is closed with a cap 18 including a nozzle 20. Cap 18 is adapted to rotate about an axis extending longitudinally through body 12 by mounting in any one of a number of manners well known in the art. Fluid 16 thus enters from pipe 14, passes through body 12 and emerges from cap 18 to be directed by nozzle 20 in a specific direction. Nozzle 20 typically is shaped to provide a desired spray pattern according to techniques which form no part of the present invention. If cap 18 is rotated continually in a circle, a circular irrigation pattern is produced. Often, however, cap 18 is reversibly driven between two positions to thereby irrigate only a portion of a circular sector. For example, such a sprinkler can be mounted at the corner of a rectangular area and by limiting the arc of rotation to 90°, the corner can be watered. In a similar manner, the sprinkler head can be placed along one side of an area and by limiting the pattern to 180°, only the inner portion of the area will be watered. Thus, by combining a plurality of sprinkler heads covering various sectors of circles, an entire area can be selectively watered.

To cause the rotation of the cap 18, a turbine motor assembly generally indicated as 22 is provided. Motor assembly 22 includes a vaned turbine 24 disposed to be driven by the flow of fluid 16. Turbine 24 drives motor 26 which in turn drives switchable drive assembly 28. Switchable drive assembly 28 is concentrically located within a toothed drive cup 30 carried by cap 18. Switchable drive assembly 28 includes a first drive gear 32 and a second drive gear 34 which rotate in opposite directions and which are adapted to be in mutually exclusive driving contact with toothed drive cup 30. That is, when first drive gear 32 is in engagement with toothed drive cup 30, cap 18 will be driven in one direction thereby, and second drive gear 34 will be in non-engagement with toothed drive cup 30. When second drive gear 34 is in engagement with toothed drive cup 30, cap 18 will be driven in the opposite direction thereby, and first drive gear 32 will be in non-engagement with toothed drive cup 30. Switchable drive assembly 28 includes switching means 36 adapted to respond to a switching activator 38 carried by cap 18. As switching activator 38 strikes switching means 36 at opposite ends of the horizontal travel of cap 18, first and second drive gears 32, 34 are alternatively engaged with toothed drive cup 30 in the manner previously described whereby cap 18 is caused to horizontally oscillate between the two positions established by the positioning of switch means 36 and switch activator 38. Typically, a stator plate 40 is disposed between a point of connection to vertical riser pipe 14 and turbine 24. Stator plate 40 is provided with a plurality of holes 42, angularly disposed therethrough so as to direct the flow of fluid 16 in an optimal manner against the vanes of turbine 24.

As will be understood, switchable drive assembly 28 and switching means 36 incorporated therein, is a complicated device. When sprinkler head 10 is of a small size, the components of switchable drive assembly 28 are very small with the problems and costs normally attendant to small, complicated devices. Heretofore, however, no other means for providing a switchable reversible sprinkler head driven by a turbine from the flow of the fluid therethrough has been successfully accomplished.

Wherefore, it is the object of the present invention to provide an easily adjustable switchably reversible sprinkler head driven by a turbine operating from the flow of the fluid therethrough which does not require a switchable gear drive assembly as a part thereof.

SUMMARY OF THE INVENTION

The foregoing objective has been accomplished by the sprinkler head of the present invention which comprises a substantially cylindrical body adapted at the lower end thereof for connection to a source of fluid under pressure; a cap including nozzle means disposed to close the upper end of the body, the cap being adapted to rotate about an axis disposed longitudinally through the body; a turbine assembly disposed longitudinally within the body having an input shaft including a vaned turbine on the lower end thereof, and an output shaft on the upper end thereof, connected to rotate the cap in one direction in response to the turbine being rotated in one direction and to rotate the cap in the opposite direction in response to the turbine being rotated in the opposite direction; and, deflector means disposed between the connection to a source of fluid under pressure and the turbine for deflecting the flow of fluid against the turbine to cause rotation thereof in the desired direction, the deflector means being movable between a first position wherein the fluid is deflected to turn the turbine in one direction and a second position wherein the fluid is deflected to turn the turbine in the opposite direction. In the preferred embodiment shown, switching means are carried by the cap and communicate with the deflector means for switching the direction of fluid deflection in response to rotation of the cap whereby the cap is made to oscillate between a first and second position. Moreover, the switching means includes means for setting the points in the rotation of the cap where the direction of fluid deflection is reversed.

DESCRIPTION OF THE PREFERRED EMBODIMENT

Figure 1:
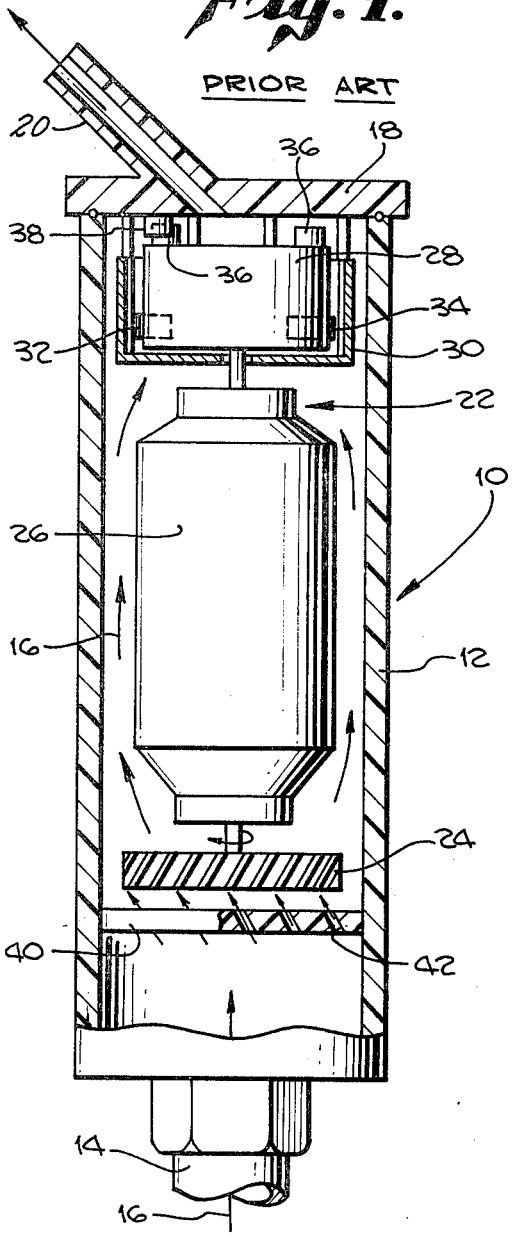
Fig. 1. PRIOR ART
FIG. 1 is a partially cut away elevation of a reversibly rotatable turbine-driven sprinkler head according to the prior art.
Figure 2:
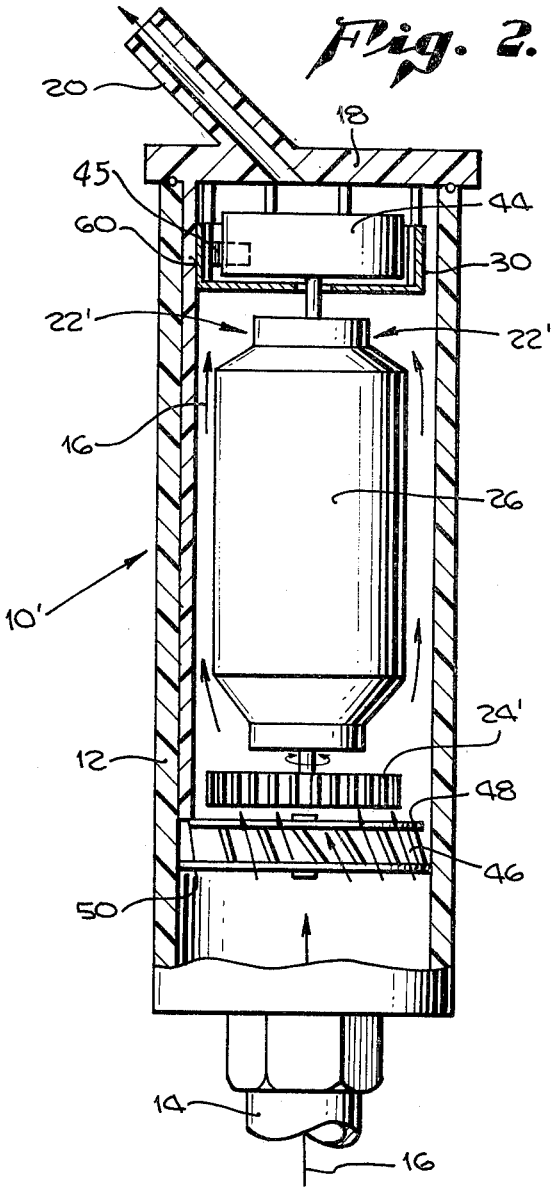
FIG. 2 is a partially cut away side elevation of a reversibly rotatable turbine-driven sprinkler head according to one embodiment of the present invention.
Figure 3:
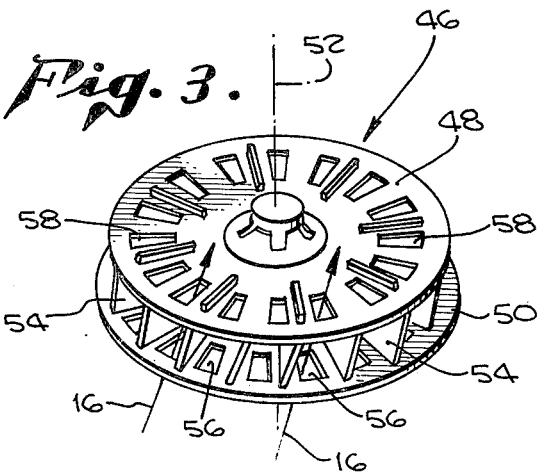
FIG. 3 is an orthographic drawing of the switchable stator plate employed in the sprinkler head of FIG. 2.
Figure 4:
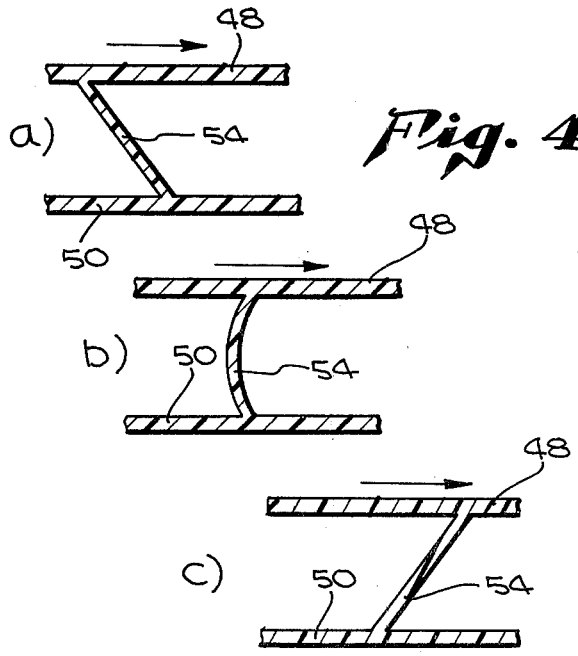
FIG. 4 is a simplified drawing of one method of switching the position of the deflector vanes in the switchable stator of the present invention.

The sprinkler head of the present invention can best be understood with reference to FIGS. 2, 3, and 4. Referring first to the embodiment of FIG. 2, the sprinkler head 10' can be seen as comprising a cylindrical body 12 adapted for connection at the lower end thereof, to a vertical riser pipe 14 supplying fluid 16 under pressure. The upper end thereof is closed by a rotatable cap 18 containing a nozzle 20 and carrying a toothed drive cup 30 in the same manner as the sprinkler head 10 of FIG. 1. A turbine motor assembly 22' is disposed to rotate cap 18. Turbine motor assembly 22' comprises a motor 26 having a vaned turbine 24' connected to the input shaft thereof and a non-switchable drive assembly 44 connected to the output shaft thereof and disposed in driving relationship with toothed drive cup 30 by means of drive gear 45. Vaned turbine 24' contains a plurality of vanes disposed longitudinally to the flow of fluid 16 through body 12. With nothing more, the flow of fluid 16 through body 12 would result in no driving force being applied to turbine 24'. In order to achieve the objectives of the present invention, a switchable stator plate 46 is disposed transverse of body 12 between the point of attachment to vertical riser pipe and vaned turbine 24'. In the configuration shown in FIG. 2 wherein switchable stator plate 46 comprises two parallel-spaced discs 48 and 50 (shown in greater detail in FIG. 3) it is preferred that stator plate 46 be placed in close adjacent parallel-spaced relationship to the bottom surface of vaned turbine 24'. As can be seen, disc 48 is conveniently of slightly smaller diameter than disc 50 which is in contact with the sidewalls of body 12 to hold switchable stater plate 46 in position. In a manner which will be described in greater detail hereinafter, switchable stator plate 46 deflects the flow of fluid 16 as shown by the arrows of FIG. 2 to impart a rotational force to vaned turbine 24'. Switchable stator plate 46 is adapted to be switched to a second position which causes the fluid 16 to be deflected in a manner such that turbine 24' is then rotated in the opposite direction.

Referring now to FIG. 3, the switchable stator plate 46 employed in the embodiment of FIG. 2 can be seen as comprising a disc-shaped upper plate 48 and a disc-shaped lower plate 50 disposed in parallel-spaced relationship. The two plates 48, 50 are adapted for rotation about a common axis 52 relative to one another between two positions to be hereinafter described. A plurality of vanes 54 are radially disposed between upper plate 48 and lower plate 50. Plates 48, 50 act as support structures for the vanes 54 which are hingedly attached on opposite sides to plates 48, 50. In the preferred embodiment as shown, lower plate 50 contains a plurality of first holes 56 equally positioned along the periphery thereof. In a similar manner, upper plate 48 contains a plurality of second holes 58 being of equal number to the first holes 56 and in like manner, disposed about the periphery thereof. Vanes 54 are disposed between each of the holes 56, 58. Thus, each pair of adjacent vanes 54 defines a passageway between a first hole 56 and a second hole 58. As can be seen, the angled passageways between adjacent vanes 54 when positioned as shown in FIG. 2 or FIG. 4 will cause the fluid 16 to be deflected away from the longitudinal axis of body 12 to impinge on the vanes of turbine 24' from an angle thereby imparting a rotational force to the turbine 24'. As previously mentioned, switchable stator plate 46 is switchable between a first position and a second position. FIGS. 2 and 3 represent these two different positions. That is, in FIG. 2 switchable stator plate 46 is deflecting fluid 16 to strike the vanes of turbine 24' from one side to impart a rotational force in one direction. As positioned in the second position of FIG. 3, fluid 16 would be deflected in the opposite direction to strike the vanes of turbine 24' on the opposite side and thereby impart a rotational force to turbine 24 in the opposite direction. As previously mentioned, non-switchable drive assembly 44 is in constant engagement with toothed drive cup 30 through drive gear 45. Contrary to the operation previously described in reference to the prior art configuration of FIG. 1 wherein change in directional rotation of cap 18 was affected by changing the engagement of first drive gear 32 and second drive gear 34 with toothed drive cup 30, in the present invention, change in directional rotation of cap 18 is affected by changing the direction of fluid 16 deflection through switchable stator plate 46 so as to physically change the direction of rotation of vaned turbine 24 and thereby cap 18.

The physical switching of vanes 54 is accomplished by causing plates 48 and 50 to rotate between their first and second positions. This is accomplished by a switching means 60 such as the extended finger as shown moving in positional relationship with cap 18 and in communication with switchable stator plate 46 whereby the rotation of cap 18 will cause upper plate 48 and lower plate 50 of switchable stator plate 46 to be rotated relative to one another since plate 50 is in engagement with body 12 and plate 48 is free to rotate in response to the urging of switching means (finger) 60 contacting, for example, shifting levers projecting upwardly from the plate 48, such as levers 76 shown in FIG. 6.

One method of providing for the switching of the relative positions of upper plate 48 and lower plate 50 is shown in simplified form in FIG. 4. In FIG. 4, only one vane 54 is shown for simplicity. As can be seen in the view of FIG. 4(*a*), the vane 54 is hingedly attached on one side to upper plate 48 and hingedly attached on the opposite side to lower plate 50. As indicated by the arrow, it is assumed that upper plate 48 is being moved to the observer's right and lower plate is remaining stationary as FIG. 4 is viewed. The same results could be achieved by holding upper plate 48 stationary and moving lower plate 50 to the left, or by moving both plates in opposite directions simultaneously. In the preferred embodiment of the configuration of FIG. 4, vanes 54 are of a flexible, deformable material such as a plastic (e.g. polypropylene, polytetrafluoroethylene) or thin metal (e.g. aluminum, steel, bronze). Thus, in the first position shown in FIG. 4(*a*), the vane 54 resists rotational movement of plates 48 and 50 as indicated by the arrow. Moreover, the length of the vane 54 between the point of attachment to upper plate 48 and lower plate 50 is longer than the parallel-spaced distance between plates 48 and 50. Thus, vane 54 has a tendency to remain in the angled position shown in FIG. 4(*a*) and resists rotational movement of upper plate 48 relative to lower plate 50. Upon the application of sufficient rotational pressure to upper plate 48, however, vane 54 deforms in the manner of FIG. 4(*b*) so as to allow vane 54 to pass from the first position of FIG. 4(*a*) towards the second position shown in FIG. 4(*c*). Upon attaining the second position of FIG. 4(*c*), the resilient material of vane 54 causes vane 54 to assume the straightened angular position shown therein to cause the deflection of the fluid in the opposite direction and resist rotational movement of upper plate 48 relative to lower plate 50 back in the direction of the first position shown in FIG. 4(*a*). Sufficient pressure applied to upper plate 48 in the direction opposite the arrow of FIG. 4(*c*) would, of course, cause deflection of vane 54 so as to allow movement from the second position back to the first position. Thus, the plates 48 and 50, and thereby vanes 54, can be switchably changed between the first position and the second position so as to cause deflection of fluid 16 in a manner which will cause the turbine 24' to operate in opposite directions.

Figure 5:
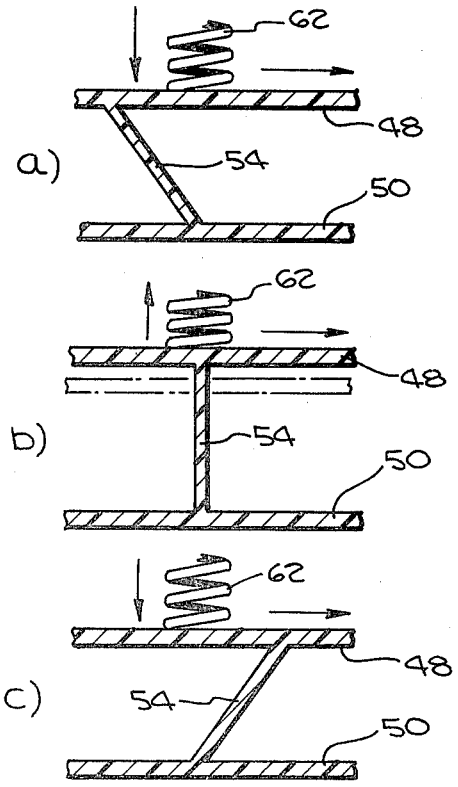
FIG. 5 is a simplified drawing of an alternate method of switching the vanes employed in the present invention.

In a second embodiment, upper plate 48 and lower plate 50 are spring-biased to their normal spaced relationship as shown in FIG. 5(*a*) by some spring means such as that shown symbolically by the spring 62. In this embodiment, the vanes 54 are of a non-deformable material such that when moving upper plate 48 relative to lower plate 50 between the first and second positions as shown by the progression of FIG. 5(*a*), (*b*) and (*c*) the spring biasing of spring 62 is overcome so as to allow the spacing between upper plate 48 and lower of plate 50 to increase sufficiently to allow the non-deformable vanes 54 to move from the first position shown in FIG. 5(*a*) to the second position shown in FIG. 5(*c*).

Figure 7:
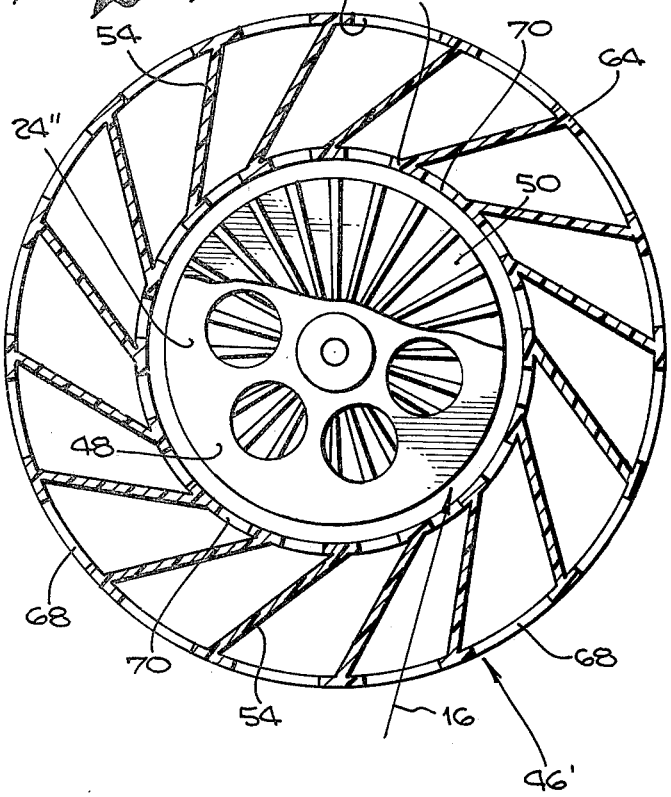
FIG. 7 is a plan view of the switchable stator assembly of the present invention as employed in the embodiment of FIG. 6.
Figure 6:
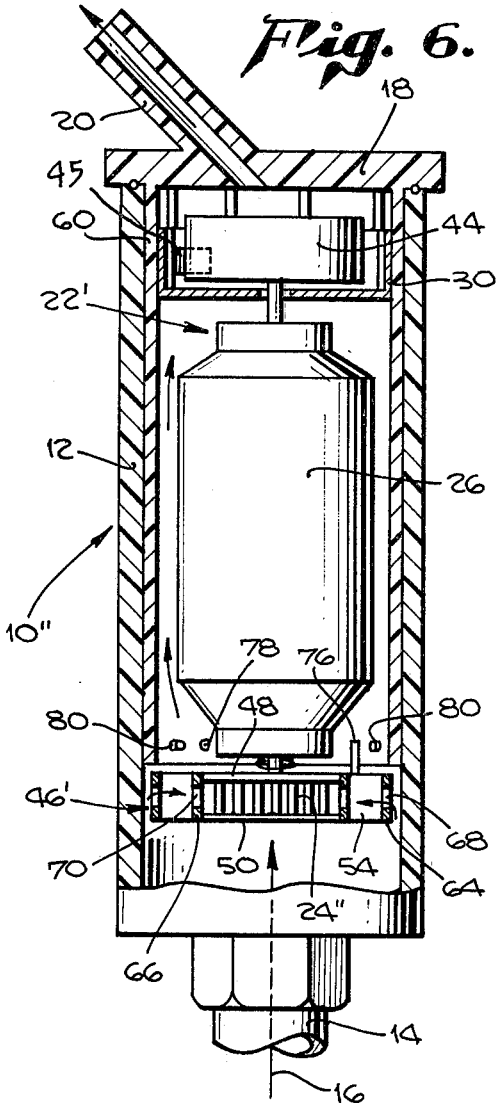
FIG. 6 is a partially cut away side elevation of an alternate embodiment of a sprinkler head according to the present invention.

Referring now to FIG. 6, an alternate embodiment 10'' of the present invention is shown as comprising the cylindrical body 12, cap 18, toothed drive cup 30, non-switchable drive assembly 44, and turbine motor assembly 22' as previously discussed in relation to FIG. 2. In the embodiment of FIG. 6, however, switchable stator plate 46' is disposed concentrically about vaned turbine 24'' as shown in greater detail in FIG. 7. Switchable stator plate 46' comprises two concentric cylinders being a rotatable outer cylinder 64 and a fixed inner cylinder 66 positionally held in any manner desired. As with the switchable stator plate 46 of FIGS. 2 and 3, switchable stator plate 46' has vanes 54 hingedly conncted between outer cylinder 64 and inner cylinder 66. Again, in a similar manner, first holes 68 are disposed in outer cylinder 64 between the point of attachment of adjacent vanes 54 thereto and second holes 70 are disposed in inner cylinder 66 between the point of attachment of adjacent vanes 54 thereto. In this embodiment, fluid 16 is directed to pass through first holes 68 to second holes 70 radially inward towards the ends of the vanes of turbine 24'' at an angle to impart the desired rotational force thereto. As with upper and lower plates 48, 50 of the configuration of FIG. 2 and FIG. 3, outer cylinder 64 and inner cylinder 66 are rotated relative to one another between first and second positions wherein fluid 16 is deflected in opposite directions to cause turbine 24'' to rotate in opposite directions. In the embodiment of FIG. 6 and FIG. 7, the technique of FIG. 4 providing deformable vanes 54 must be employed as the technique of FIG. 5 cannot be employed successfully with concentric cylinders providing the spaced surfaces therebetween.

While the configurations of the present invention herein before described have employed non-switchable drive assemblies 44 in conjunction with a toothed drive cup 30 to rotate cap 18, it is to be understood that this merely allows for maximum interchangeability between the parts of sprinkler heads according to the prior art as described in relationship to FIG. 1 and sprinkler heads according to the present invention. By providing a motor 26' incorporating sufficient reduction gearing that the output shaft 72 thereof is rotating at the desired speed of rotation of cap 18, cap 18 can be directly connected thereto in the manner shown in FIG. 8. By threading output shaft 72 and providing a knurled nut 74, cap 18 is thereby made easily removable.

Figure 8:
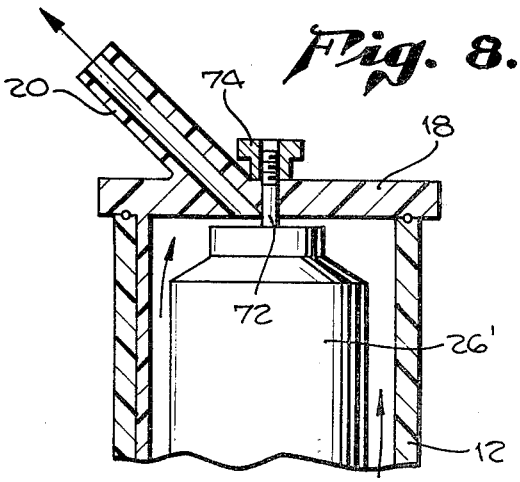
FIG. 8 is a partially cut away side elevation of an alternate method of attaching the nozzle-containing cap of the present invention to the turbine motor assembly.

Referring once again to FIG. 6, the removable cap 18 described with relation to FIG. 8 could be well-adapted to the embodiment of either FIG. 2 or FIG. 6 thus allowing for easy adjustability of the two points of deflection switching. For example, in FIG. 6 the inner cylinder 66 could be held against rotation by holding means (not shown) such as projecting arms from body 12 and outer cylinder 64 fit with a vertically projecting shifting lever 76. By configuring switching means 60 as a cylinder carried by cap 18 disposed internally of cylindrical body 12, as shown in FIG. 6 and providing a plurality of holes 78 along the lower periphery thereof, switching pins 80 could be disposed to project from holes 78 to contact shifting lever 76 as cap 18 and switching means 60 rotate together so as to switch stator plate 46'. The position of switching pins 80 could be easily modified by removing switching means 60 from body 12 to allow switching the position of switching pins 80 from one hole 78 to another.

Thus, it can be seen, that the present invention has successfully met its objectives of providing an easily adjustable sprinkler head using turbine power derived from the flow of fluid therethrough to drive a rotatable nozzle in an oscillatory fashion between two positions without resorting to the prior art techniques of a complex switchable gear-driven drive assembly.

Having thus described my invention, I claim:

1. In a sprinkler head having a body adapted for connecting to a conduit supplying fluid under pressure and including a vaned turbine for rotating in response to fluid flowing through the body, motor means driven by the turbine, and a nozzle for directing the fluid emerging from the body adapted for rotation by the motor, the improvement for causing the nozzle to be repeatably rotated between a first point and a second point comprising:

(a) means for directing the fluid flow against the turbine being switchable between a first position where the turbine is rotated in one direction and a second position where the turbine is rotated in the opposite direction, said switchable directing means comprising (a1) a first support structure having a plurality of first holes therein, being disposed in the body of the sprinkler head between the connection to the source of fluid under pressure and the turbine, whereby at least a portion of the fluid is directed through said first holes, (a2) a second support structure having a plurality of second holes therein, being disposed in parallel-spaced relationship to said first support structure between said first support structure and the turbine, said first and second support structures being rotatable with respect to one another about a common axis between a first position and a second position, and, (a3) a plurality of deflecting vanes disposed between said first and second support structures, being hingedly attached to said first support structure on one side and hingedly attached to said second support structure on the opposite side, said deflecting vanes being longer between said points of attachment to said first and second support structures than the spacing between said first and second structures, so that said deflecting vanes are angularly disposed between said first and second support structures whereby fluid entering said first holes is angularly directed out said second holes against the vanes of the turbine by said deflecting vanes, said deflecting vanes being movable as said first and second support structures are rotated with respect to one another between said first and second positions of a first angular position wherein the fluid is directed to rotate the turbine in one direction and a second angular position wherein the fluid is directed to rotate the turbine in an opposite direction; and, (b) means responsive to the position of the nozzle for switching said switchable directing means at said first point and said second point whereby the motor is driven and thereby the nozzle is rotated between the first point and the second point by the repeated switching of said switchable directing means between said first and second positions.

2. The sprinkler head claimed in claim 1 wherein:

said first and second support structures are a pair of concentric cylinders disposed about the periphery of the turbine.

3. The sprinkler head claimed in claim 2 wherein:

said deflecting vanes are deformable to allow said first and second support structures to be rotated between said first and second positions.

4. The sprinkler head claimed in claim 3 wherein:

said deflecting vanes are of a material having a positive return force to its non-deformed state whereby said deflecting vanes are biased to resist relative movement of said first and second support structures from said first and second positions.

5. The sprinkler head claimed in claim 1 wherein:

said first and second support structures are a pair of discs disposed in close adjacent parallel-spaced relationship to the turbine.

6. The sprinkler head claimed in claim 5 wherein:

said deflecting vanes are deformable to allow said first and second support structures to be rotated between said first and second positions.

7. The sprinkler head claimed in claim 6 wherein:

said deflecting vanes are of a material having a positive return force to its non-deformed state whereby said deflecting vanes are biased to resist relative movement of said first and second support structures from said first and second positions.

8. The sprinkler head claimed in claim 5 wherein:

(a) said deflecting vanes are non-deformable; and, (b) said first and second support structures are spring-biased to their normal parallel-spaced relationship but movable apart against said spring-bias to provide clearance for said non-deformable vanes therebetween as said support structures are rotated between said first and second positions.

9. a reversible turbine-drive sprinkler head comprising:

(a) a substantially cylindrical body adapted at the lower end thereof for connection to a source of fluid under pressure;

(b) a cap including nozzle means disposed to cover and close the upper end of said body, said cap being adapted to rotate about an axis disposed longitudinally through said body;

(c) a turbine assembly disposed longitudinally within said body, having an input shaft including a vaned turbine on the lower end thereof and an output shaft on the upper end thereof, connected to rotate said cap in one direction in response to said turbine being rotated in one direction and to rotate said cap in the opposite direction in response to said turbine being rotated in the opposite direction;

(d) deflector means disposed between said connection to a source of fluid under pressure and said turbine for deflecting the flow of fluid against said turbine to cause rotation thereof in the desired direction, said deflector means being movable between a first position wherein the fluid is deflected to turn the turbine in one direction and a second position wherein the fluid is deflected to turn the turbine in the opposite direction; and, (e) switching means carried by said cap in communicating with said deflector means for switching the direction of fluid deflection in response to rotation of said cap, whereby said cap is made to oscillate between a first and second position, said switchable directing means comprising (e1) a first support structure having a plurality of first holes therein being disposed in the body of the sprinkler head between the connection to the source of fluid under pressure and the turbine, whereby at least a portion of the fluid is directed through said first holes, (e2) a second support structure having a plurality of second holes therein, being disposed in parallel-spaced relationship to said first support structure between said first support structure and the turbine, said first and second support structures being rotatable with respect to one another about a common axis between a first position and a second position, and, (e3) a plurality of deflecting vanes disposed between said first and second support structures, being hingedly attached to said first support structure on one side and hingedly attached to said second support structure on the opposite side, said deflecting vanes being longer between said points of attachment to said first and second support structures than the spacing between said first and second support structures so that said deflecting vanes are angularly disposed between said first and second support structures whereby fluid entering said first holes is angularly directed out said second holes against the vanes of the turbine by said deflecting vanes, said deflecting vanes being movable as said first and second support structures are rotated with respect to one another between said first and second positions from a first angular position wherein the fluid is directed to rotate the turbine in one direction and a second angular position wherein the fluid is directed to rotate the turbine in the opposite direction.

10. The sprinkler head claimed in claim 9 wherein:

said first and second support structures are a pair of concentric cylinders disposed about the periphery of the turbine.

11. The sprinkler head claimed in claim 10 wherein: said deflecting vanes are deformable to allow said first and second support structures to be rotated between said first and second positions.

12. The sprinkler head claimed in claim 11 wherein: said deflecting vanes are of a material having a positive return force to its non-deformed state, whereby said deflecting vanes are biased to resist relative movement of said first and second support structures from said first and second positions.

13. The sprinkler head claimed in claim 9 wherein: said first and second support structures are a pair of discs disposed in close adjacent parallel-spaced relationship to the turbine.

14. The sprinkler head claimed in claim 13 wherein: said deflecting vanes are deformable to allow said first and second support structures to be rotated between said first and second positions.

15. The sprinkler head claimed in claim 14 wherein: said deflecting vanes are of a material having a positive return force to its non-deformed state, whereby said deflecting vanes are biased to resist relative movement of said first and second support structures from said first and second positions.

16. The sprinkler head claimed in claim 13 wherein:
(a) said deflecting vanes are non-deformable; and,
(b) said first and second support structures are spring-biased to their normal paralle-spaced relationship but movable apart against said spring bias to provide clearance for said non-deformable deflecting vanes therebetween as said support structures are rotated between said first and second positions.

* * * * *